US006703993B2

(12) United States Patent
Miura et al.

(10) Patent No.: US 6,703,993 B2
(45) Date of Patent: Mar. 9, 2004

(54) DRIVING METHOD FOR LIQUID CRYSTAL DEVICE

(75) Inventors: Seishi Miura, Kanagawa-ken (JP); Hirohide Munakata, Kanagawa-ken (JP); Hideo Mori, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 09/818,546

(22) Filed: Mar. 28, 2001

(65) Prior Publication Data

US 2002/0000962 A1 Jan. 3, 2002

(30) Foreign Application Priority Data

Mar. 31, 2000 (JP) ..... 2000-099242

(51) Int. Cl.[7] ..... G09G 3/36

(52) U.S. Cl. ..... 345/87; 345/93; 345/95; 345/96; 345/97; 345/100; 345/204; 345/214; 349/33; 349/172; 349/174

(58) Field of Search ..... 345/87, 93, 95, 345/96, 97, 101, 204, 214; 349/33, 172, 174

(56) References Cited

U.S. PATENT DOCUMENTS

| | | | | |
|---|---|---|---|---|
| 4,367,924 A | | 1/1983 | Clark et al. | 350/334 |
| 5,270,848 A | | 12/1993 | Takabayashi et al. | 359/88 |
| 5,490,000 A | * | 2/1996 | Tanaka et al. | 349/33 |
| 5,517,208 A | | 5/1996 | Mori et al. | 345/87 |
| 5,592,192 A | * | 1/1997 | Kanbe et al. | 345/97 |
| 5,847,799 A | | 12/1998 | Tanaka et al. | 349/174 |
| 5,903,251 A | | 5/1999 | Mori et al. | 345/101 |
| 5,956,010 A | | 9/1999 | Asao et al. | 345/94 |
| 5,995,076 A | * | 11/1999 | Tsuboyama et al. | 345/97 |
| 5,999,157 A | | 12/1999 | Ito et al. | 345/94 |
| 6,037,920 A | * | 3/2000 | Mizutome et al. | 345/87 |
| 6,061,044 A | | 5/2000 | Ohno et al. | 345/95 |
| 6,069,600 A | | 5/2000 | Saishu et al. | 345/87 |
| 6,083,574 A | * | 7/2000 | Asao et al. | 428/1.1 |
| 6,160,605 A | | 12/2000 | Murayama et al. | 349/152 |
| 6,177,968 B1 | | 1/2001 | Okada et al. | 349/38 |
| 6,236,385 B1 | * | 5/2001 | Nomura et al. | 345/95 |
| 6,496,170 B1 | * | 12/2002 | Yoshida et al. | 345/87 |

FOREIGN PATENT DOCUMENTS

| | | |
|---|---|---|
| JP | 56-107216 | 8/1981 |
| JP | 9-50049 | 2/1997 |
| JP | 11-30789 | 2/1999 |

OTHER PUBLICATIONS

S. Seomun et al., "Evolution of Switching Characteristics from Tristable to V–Shaped in an Apparently Antiferroelectric Liquid Crystal", Jpn. J. Appl. Phys. vol. 36 (1997) pp. 3586–3590. 1, No. 6A.

M. Schadt et al., "Voltage–Dependent Optical Activity Of A Twisted Nematic Liquid Crystal", Applied Physics Letters, vol. 18, No. 4, Feb. 15, 1971, pp. 127–128.

A.D.L. Chandani et al., "Tristable Switching in Surface Stabilized Ferroelectric Liquid Crystals with a Large Spontaneous Polarization", Japanese Journal of Applied Physics, vol. 27, May 1988, pp. L729–L732.

* cited by examiner

*Primary Examiner*—Bipin Shalwala
*Assistant Examiner*—Vincent E. Kovalick
(74) *Attorney, Agent, or Firm*—Fitzpatrick, Cella, Harper & Scinto

(57) ABSTRACT

A driving method for a liquid crystal device comprising a pair of electrodes and a liquid crystal disposed between the electrodes includes a sequence of voltage application operations each comprising application of a reset voltage to the liquid crystal for placing the liquid crystal in a reset state in a reset period and application of a data voltage to the liquid crystal for placing the liquid crystal in a desired gradational display state in a writing period subsequent to the reset period. Each reset voltage is set to provide a prescribed difference in voltage between the each reset voltage and a subsequent data voltage, thus preventing an image memory phenomenon without using an additional reset circuit for exclusively applying the reset voltage to the liquid crystal.

9 Claims, 13 Drawing Sheets

DRIVING METHOD FOR LIQUID CRYSTAL DEVICE

FIELD OF THE INVENTION AND RELATED ART

The present invention relates to a driving method for a liquid crystal device for use in flat-panel displays, projection displays, printers, etc.

As a type of a liquid crystal (liquid crystal device) for displaying various data (information) by using a liquid crystal, there have been known those using a nematic liquid crystal or a chiral smectic liquid crystal. A liquid crystal device using a chiral smectic liquid crystal has an advantage of, e.g., higher response speed than that using a nematic liquid crystal, thus being expected to be widely utilized.

More specifically, a twisted nematic (TN) liquid crystal has widely been used conventionally as a material for a liquid crystal device as described by M. Schadt and W. Helfrich, "Applied Physics Letters", Vol.18, No.4 (Feb. 15, 1971), pp. 127–128. The TN liquid crystal is used in an active matrix-type liquid crystal device (panel) in combination with switching elements such as thin film transistors (TFTs). The active matrix-type liquid crystal device is free from a problem of cross-talk and is produced with high productivity with respect to that having a size (diagonal length) of 10–17 in. with a progress of production technique.

However, the above-mentioned liquid crystal device using the TN liquid crystal has been accompanied with problems such as a slower response speed and a narrower viewing angle.

In order to solve the problems, various alignment modes including an optically compensated bend or birefringence (OCB) mode for improving a response speed, and In-Plain Switching mode and Vertical Alignment mode for improving a viewing angle have been proposed but are not said to be satisfactory for improvements in response seed and/or viewing angle.

In order to solve the problems of the conventional TN liquid crystal devices, a liquid crystal device using a chiral smectic liquid crystal exhibiting bistability has been proposed by Clark and Lagerwall (Japanese Laid-Open Application (JP-A) 56-107216, U.S. Pat. No 4367924). As the liquid crystal exhibiting bistability, a ferroelectric liquid crystal having chiral smectic C phase is generally used. Such a ferroelectric liquid crystal provides a very quick response speed because it causes inversion switching of liquid crystal molecules based on their spontaneous polarizations. In addition, the ferroelectric liquid crystal assumes bistable state showing a memory characteristic and further has an excellent viewing angle characteristic, thus being considered to be suitable for a display device or light-valve of high speed, high definition and larger area.

In recent years, an anti-ferroelectric liquid crystal exhibiting tristable state has been proposed by (chandani, Takezoe et al. ("Japanese Journal of Applied Physics", vol. 27 (1988), pp. L729-). The anti-ferroelectric liquid crystal also provides a very quick response speed due to inversion switching based on spontaneous polarization similarly as in the ferroelectric liquid crystal.

As another type of the chiral smectic liquid crystal, there has been recently proposed a chiral smectic liquid crystal providing a V-character shaped response characteristic (voltage-transmittance characteristic) which is advantageous for gradational image display and is free from hysteresis (e.g., "Japanese Journal of Applied Physics", Vol. 36 (1997), pp. 3586-).

Further, an active matrix-type liquid crystal device using such a chiral smectic liquid crystal providing the V-shaped voltage-transmittance characteristic has also been proposed (JP-A 9-50049).

In recent years, the above-mentioned liquid crystal devices are required to be used for displaying motion (picture) images.

In the case where motion (picture) image are displayed by a liquid crystal panel, images to be displayed (still (picture) images) are changed for each frame period. In this case, if such a change in image is always recognized by a viewer, a transitional state of the image change is also consequently recognized, thus lowering image qualities of motion images. In order to solve the problem, a backlight (unit) is turned on only in a period wherein the still image display is completed in the liquid crystal panel.

Such a liquid crystal panel for displaying motion images is, however, accompanied with a problem of a hysteresis with respect to an alignment state of a liquid crystal used.

Specifically, such a hysteresis is a phenomenon that even when a prescribed voltage is applied for displaying a gradational (display) state of 50% in a frame period, the gradational state (level) of 50% cannot be realized by the influence of a gradational state in its preceding frame period.

In the conventional liquid crystal devices, in order to solve the above hysteresis phenomenon, a reset voltage has been applied in each frame period.

More specifically, in the conventional liquid crystal device, as shown by $V_R$ at (e) in FIG. 14, a fixed voltage (0 V in the figure) has been applied as a reset voltage. For this purpose, the liquid crystal device is required to additionally providing a reset circuit including a switching element 30 (for forcedly providing buffer circuit with a uniform potential), a terminal (for providing the buffer circuit with a potential corresponding to a reset potential), and a gate terminal 32 of the switching element 30 (for controlling the timing for supplying the potential corresponding to a reset potential to the buffer circuit via the switching element) as shown in FIG. 15, thus resulting in a complicated pixel circuit. FIG. 15 shows an embodiment of an equivalent circuit of the conventional liquid crystal device. Referring to FIG. 15, in addition to the reset circuit 30 (encoding the reset line 31 and the reset switching element 32), the conventional liquid crystal device includes a liquid crystal 1, a pair of electrodes 2*a* and 2*b*, a first switching element 3, a gate line 4, a signal line 5, a first storage (holding) capacitor 6, a first buffer circuit 7, a second switching element 8, a second buffer circuit 9, a common control line 10, a counter electrode potential 11, a common potential 12 and a second storage (holding) capacitor 13.

When the conventional liquid crystal device as shown in FIG. 15 in driven for continuously displaying a black state in a certain pixel while setting a reset voltage of 0 V as shown at (b) in FIG. 16, a resultant voltage-transmittance characteristic (V-T characteristic) at the certain pixel as indicated by a curve connecting white squares (-□-□-) shown in FIG. 17 is different from a curve connecting black squares (-■-■-) shown in FIG. 17 indicating a V-T characteristic in the case of continuously displaying a white state at another pixel while setting a reset voltage of 0 V as shown at (a) in FIG. 16 (in this case, reset period =1 msec and writing period =8.33 msec are set), thus resulting in an occurrence of so-called image memory (burning or sticking) wherein a gradational image displayed on the liquid crystal panel as a whole is different from a gradational image to be displayed.

Further, in the case where the conventional liquid crystal device is driven for displaying full-color images according to a field-sequential driving scheme, a part of image data displayed in ia preceding frame period is displayed in a current frame period, thus resulting in an actually displayed color image which is different from a color image to be displayed originally, i.e., a poor color reproducibility.

SUMMARY OF THE INVENTION

An object of the present invention is to provide a driving method for a liquid crystal device capable of displaying appropriate gradational images while controlling a reset voltage for resetting a liquid crystal in a prescribed state without using an additional circuit (device) for exclusively applying a reset voltage.

Another object of the present invention is to provide a driving method for a liquid crystal device capable of suppressing an occurrence of image memory phenomenon.

According to the present invention, there is provided a driving method for a liquid crystal device comprising a pair of electrodes and a liquid crystal disposed between the electrodes, said driving method comprising:

a sequence of voltage application operations each comprising application of a reset voltage to the liquid crystal for placing the liquid crystal in a reset state in a reset period and application of a data voltage to the liquid crystal for placing the liquid crystal in a desired gradational display state in a writing period subsequent to the reset period, wherein each reset voltage is set to provide a prescribed difference in voltage between said each reset voltage and a subsequent data voltage.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described more specifically based on preferred embodiments with reference to the drawings.

An example of a liquid crystal device driven by the driving method of the present invention will be described with reference to FIGS. 2–4.

Figure 2:
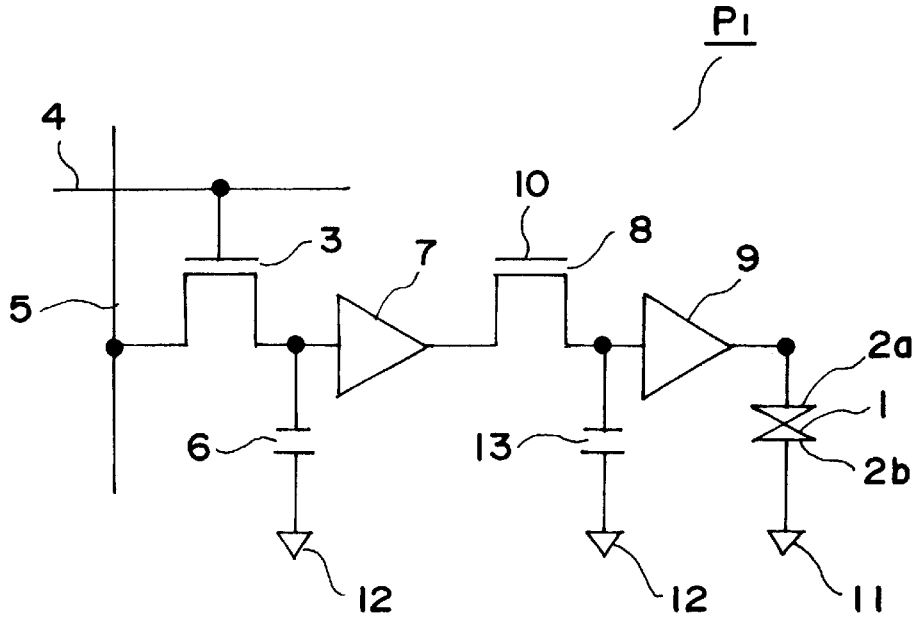
FIG. 2 is an equivalent circuit diagram of an embodiment of a liquid crystal device to which the driving method of the present invention is applied.

FIG. 2 is an equivalent circuit diagram of a liquid crystal device to which the driving method of the present invention is applied.

Referring to FIG. 2, a liquid crystal device P1 comprises at least a liquid crystal 1 and a pair of electrodes (pixel electrode and counter electrode) 2*a* and 2*b* sandwiching the liquid crystal 1 and supplying a voltage to the liquid crystal 1. A backlight unit or device (not shown) is disposed opposite to the liquid crystal device P1.

The liquid crystal device used in the present invention may preferably be of an active matrix-type using a plurality of switching elements, such as TFTs.

Referring again to FIG. 2, the liquid crystal device P1 further comprises a first switching element 3 provided to each pixel, a gate line 4 connected to a gate of the first switching element 3, a signal line 5 connected to a source of the first switching element 3, a first storage (holding) capacitor 6, a first buffer circuit 7, a second switching element 8, a second buffer circuit 9, a common control line 10 connected to the second switching element 8 and applying a signal thereto for turning the second switching element 8 "ON" or "OFF", a counter electrode potential 11, a common potential 12, and a second storage capacitor 13. The common control line is connected to second switching element 8 of all the pixels and adapted to control all the switching element 8 so as to be turned "ON" or "OFF" at the same time.

Figure 4:
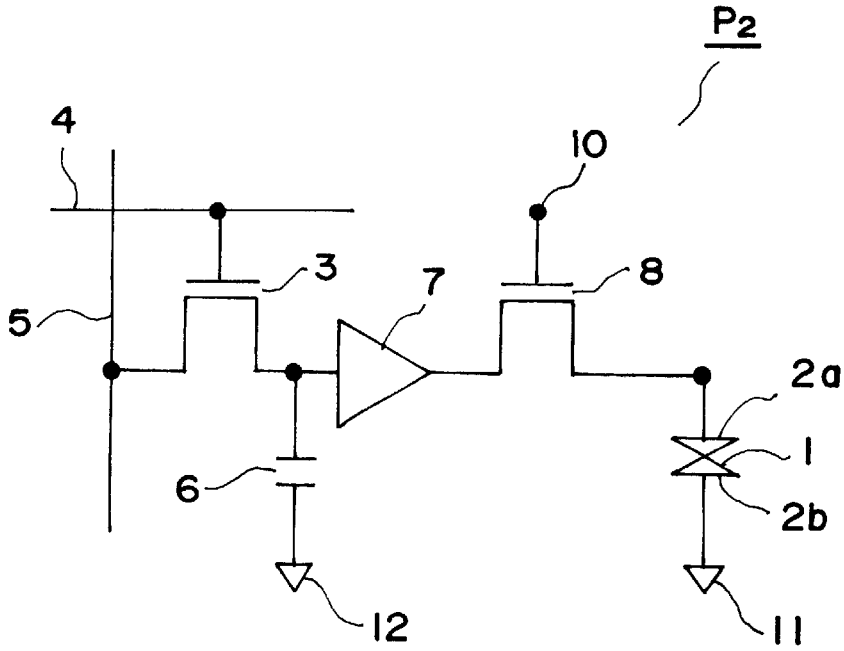
FIG. 4 is an equivalent circuit diagram of another embodiment of a liquid crystal device to which the driving method of the present invention is applied.

FIG. 4 is another equivalent circuit diagram of a liquid crystal device driven by the driving method of the present invention.

Referring to FIG. 4, a liquid crystal device P2 has a similar circuit structure to that shown in FIG. 2 except that a second circuit portion including the second buffer circuit 9 and the second storage capacitor 13 is not provided.

Figure 3:
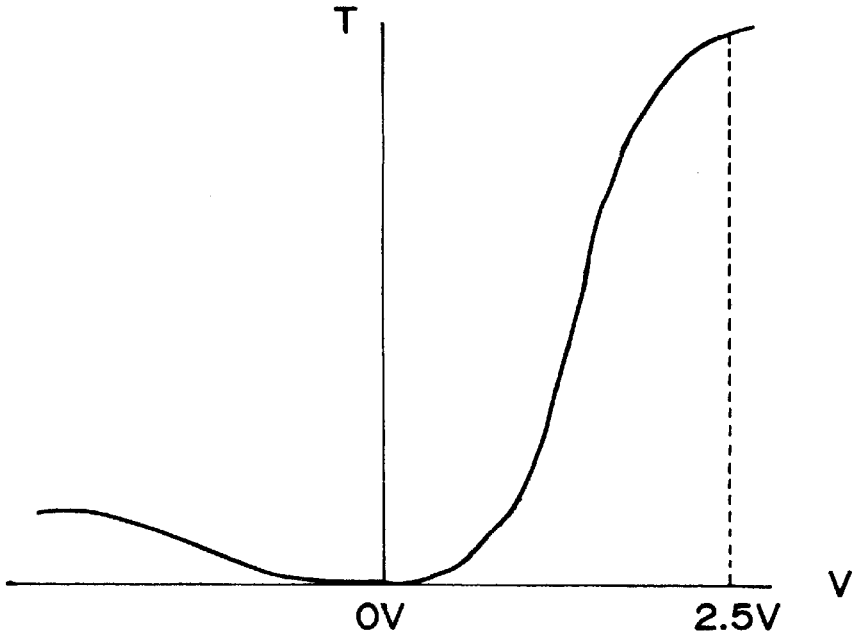
FIG. 3 is a graph showing an embodiment of a V-T (voltage-transmittance) characteristic of a liquid crystal used in the driving method of the present invention.

The liquid crystal 1 may preferably be a smectic liquid crystal such as one providing a V-T characteristic (voltage-transmittance characteristic) as shown in FIG. 3.

Referring to FIG. 3, the smectic liquid crystal provides a transmittance of substantially 0% when a voltage is not applied thereto. The transmittance is moderately changed continuously depending on a magnitude of an applied voltage when supplied with a voltage of one polarity (e.g., positive polarity). On the other hand, the transmittance is also moderately changed continuously depending on a magnitude of an applied voltage when supplied with a voltage of the other polarity (e.g., negative polarity). As apparent from FIG. 3, a degree of change in transmittance is larger on the positive voltage side and smaller on the negative voltage side. The transmittance on the negative voltage side is closer to 0% but is non-zero value.

The backlight unit may preferably comprise a LED (light-emitting diode) or a cold-cathode tube providing shorter afterglow but is not limited thereto.

Hereinbelow, a preferred embodiment of the driving method for a liquid crystal device according to the present invention will be described with reference to FIG. 1.

When the liquid crystal device P1 used in the present invention is driven, a reset voltage $V_R$ is first applied to the liquid crystal 1 via the pair of electrodes 2*a* and 2*b* to effect a reset of a preceding (previous) display state of the liquid crystal 1 in a period $F_{11}$. In a subsequent period $F_{12}$, a data voltage $V_D$ is applied to the liquid crystal 1 to effect a desired gradational display. Thereafter, a backlight unit is turned on to illuminate the liquid crystal device P1 with light.

Such a voltage application operation including the reset voltage application and the data voltage application is sequentially performed with respect to all the pixels, whereby a gradational image is formed over the entire display area of the liquid crystal device P1 and recognized by a viewer through lighting of the backlight unit. The lighting of the backlight unit may preferably be performed at the time when the liquid crystal 1 exhibits an optical response to some extent by the application of the data voltage $V_D$ to all the pixels.

The above-mentioned voltage application operation and lighting of the backlight unit are repetitively performed periodically on the basis of a certain unit period (frame period $F_0$). The displayed gradational image is changed for each frame period $F_0$, thus being recognized as motion (picture) images.

In this embodiment, the reset voltage $V_R$ comprises the data voltage $V_D$ superposed with certain voltage (superposition voltage $V\alpha$ and may appropriately be determined so as to place the liquid crystal material in a substantially certain state depending on the applied voltage. In other words, the reset voltage may be determined so as to complete switching of the liquid crystal material in a reset period.

The data voltage $V_D$ is applied to the liquid crystal 1 so as to display a desired gradational image and is determined depending on a gradational level (state) to be displayed.

When the liquid crystal 1 used has the VT characteristic shown in FIG. 3, the superposition voltage $V\alpha$ corresponds to a voltage of −2.5 V which is equal in absolute value to but different in polarity (sign) from a voltage of +2.5 V providing a maximum (saturation) transmittance. In other cases, the superposition voltage $V\alpha$ may appropriately be set depending on a switching speed (response characteristic) of the liquid crystal used. Further, the superposition voltage $V\alpha$ may be changed depending on an ambient temperature of the liquid crystal device used. In the present invention, the superposition voltage $V\alpha$ corresponds to a difference in voltage between the reset voltage $V_R$ and the data voltage $V_D$ and is constant over all the sequence of voltage application operations.

Figure 1:
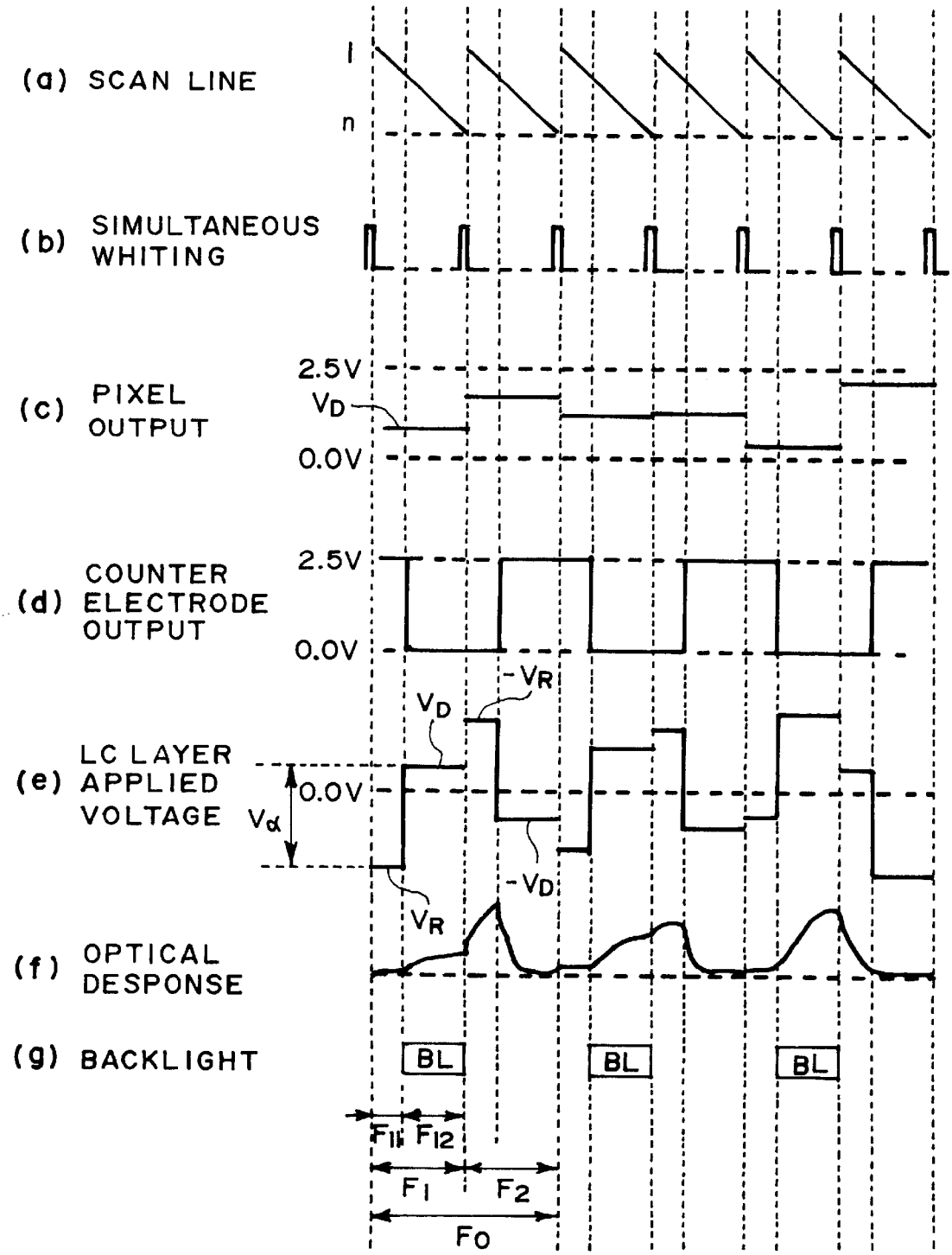
FIG. 1 is a time chart for illustrating an embodiment of the driving method for a liquid crystal device according to the present invention.

The data voltage $V_D$ is applied to the liquid crystal 1 in the prescribed period $F_{12}$ as shown in FIG. 1. The period $F_{12}$ may be changed depending on an ambient temperature of the liquid crystal device used.

Referring to FIG. 1, after the liquid crystal 1 is successively supplied with a set of the reset voltage $V_R$ (in the period $F_{11}$) and a data voltage $V_D$ (in the period $F_{12}$) in a field period $F_1$ (=$F_{11}$+$F_{12}$), in a subsequent field period $F_2$, the liquid crystal 1 is supplied with a set of a reset voltage $-V_R$ which is equal in absolute value to but different in polarity from the reset voltage $V_R$ (in the period $F_{12}$) and a data voltage $V_D$ which is equal in absolute value to but different in polarity from the data voltage $V_D$ (in the period $F_{12}$), thus completing one frame period $F_0$.

In the frame period $F_0$, the voltage applied to the liquid crystal 1 is modified into an alternating form. The voltage application operation in the frame period $F_0$ is repeated sequentially, thus preventing a deterioration of the liquid crystal 1 attributable to a DC component of the applied voltage.

Figure 8:
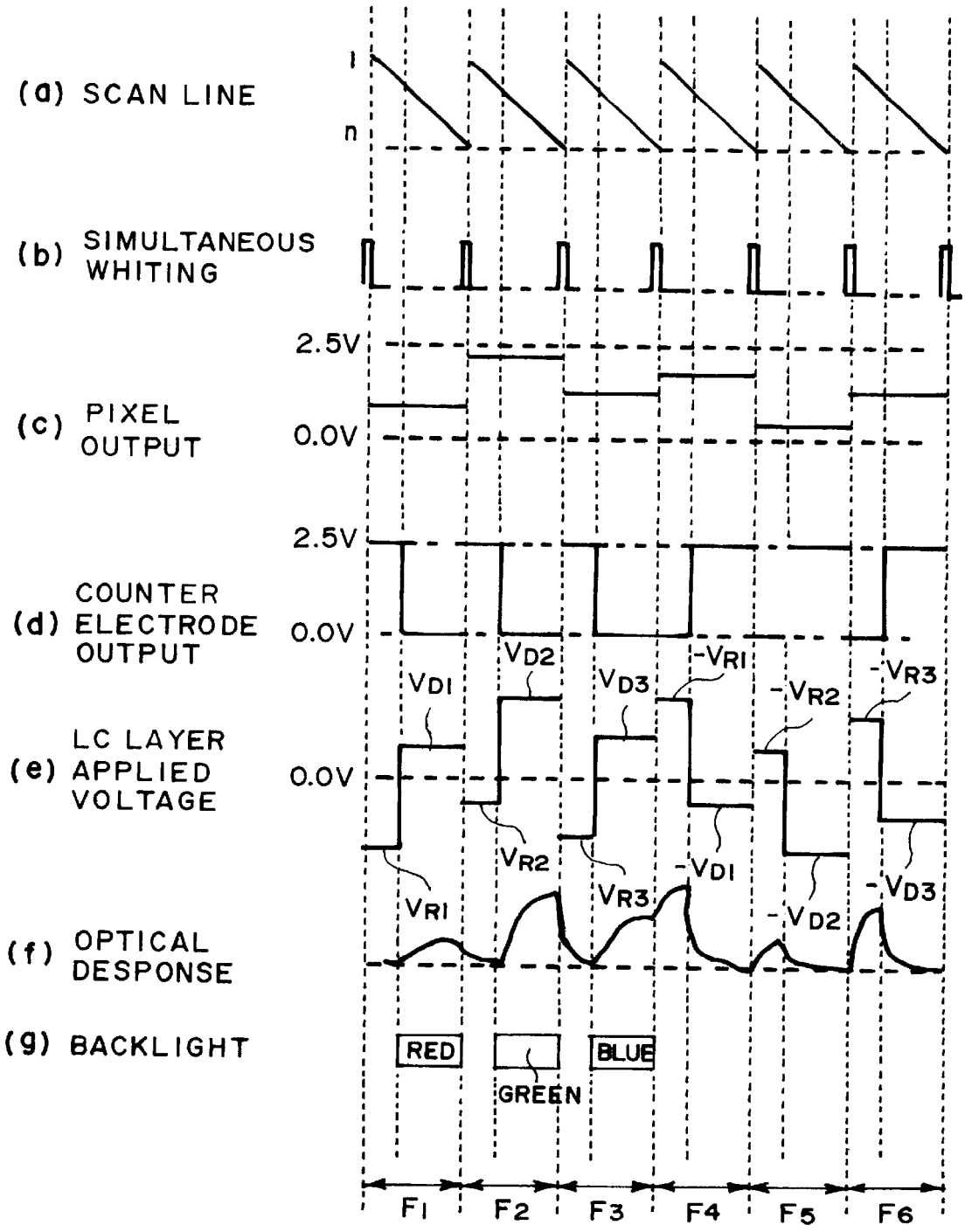

The liquid crystal device described above may be driven by a driving method according to a field-sequential driving scheme as shown in FIG. 8.

Referring to FIG. 8, three sets of reset voltages and data voltages ($V_{R1}$ and $V_{D1}$, $V_{R2}$ and $V_{D2}$, and $V_{R3}$ and $V_{D3}$) are successively applied to the liquid crystal 1 in three field periods $F_1$, $F_2$ and $F_3$, respectively. Thereafter, other three sets of reset voltages and data voltages ($-V_{R1}$ and $-V_{D1}$, $-V_{R2}$ and $-V_{D2}$, and $-V_{R3}$ and $-V_{D3}$) having the same absolute value as but a different polarity from those in the field periods $F_1$, $F_2$ and $F_3$, respectively are successively applied to the liquid crystal 1 in subsequent three field periods $F_4$, $F_5$ and $F_6$, respectively.

In this embodiment (FIG. 8), the liquid crystal device is illuminated with light issued from the backlight unit so that the color of the illumination light is successively changed in synchronism with the timing of data voltage application, i.e., R (red) for $V_{D1}$, G (green) for $V_{D2}$ and B (blue) for $V_{D3}$, thus displaying a plurality of color images which are recognized by a viewer. At that time, based on an afterimage phenomenon of human eyes, the above-displayed plural color images are color-mixed to be recognized as a full-color image.

Figure 15:
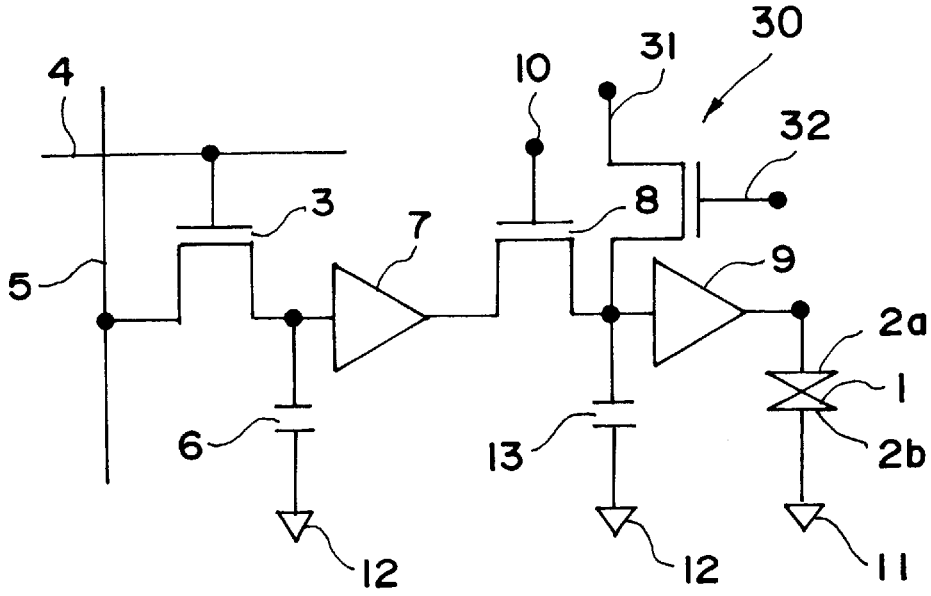
FIG. 15 is an equivalent circuit diagram of an embodiment of a liquid crystal device to which a conventional driving method of the present invention is applied.

According to the above-described embodiments, as the reset voltage $V_R$, a voltage which comprises a data voltage $V_D$ superposed with a superposition voltage $V\alpha$ and varies depending on the data voltage $V_D$ providing a desired gradational state is used, thus simplifying a circuit structure of the liquid crystal device when compared with the conventional liquid crystal device having the reset circuit 30 as shown in FIG. 15. Specifically, in the driving method according to the present invention, when the liquid crystal device is driven, a portion of the liquid crystal 1 at each pixel is placed in a reset state without using the reset circuit 30 for exclusively applying a fixed reset voltage (e.g., 0V) the portion of the liquid crystal 1. As a result, in each frame period, an appropriate gradational image free from the influence of a preceding gradational image (in a preceding frame period) is effectively displayed, thus improving display image qualities.

Figure 16:
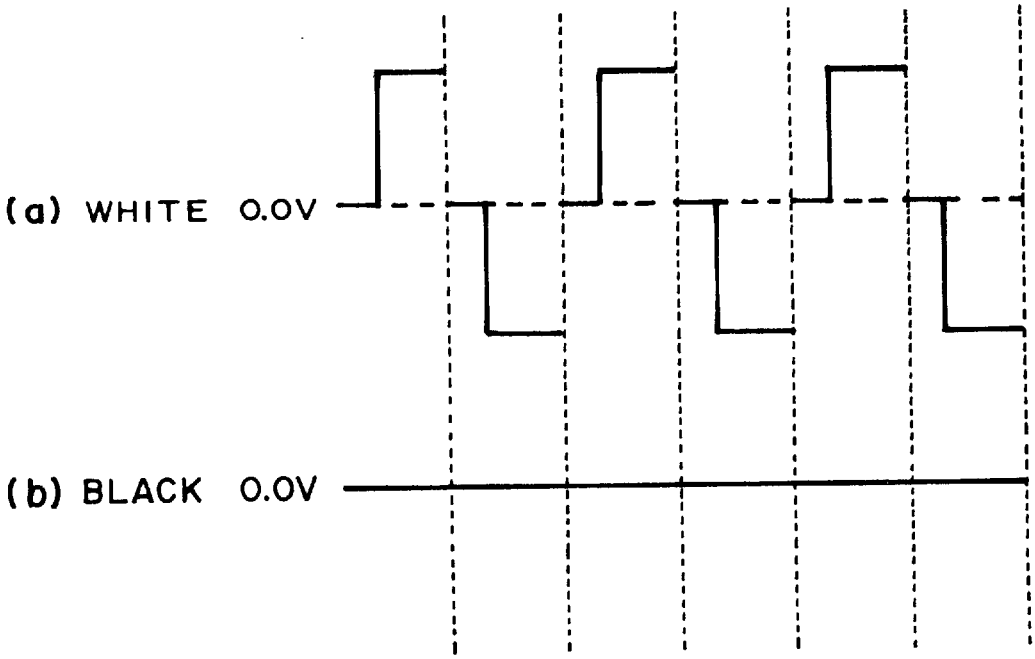
FIG. 16 shows at (a) a driving waveform for continuously (successively) displaying a white state and at (b) a driving waveform for continuously displaying a black state used in a conventional driving method.
Figure 17:
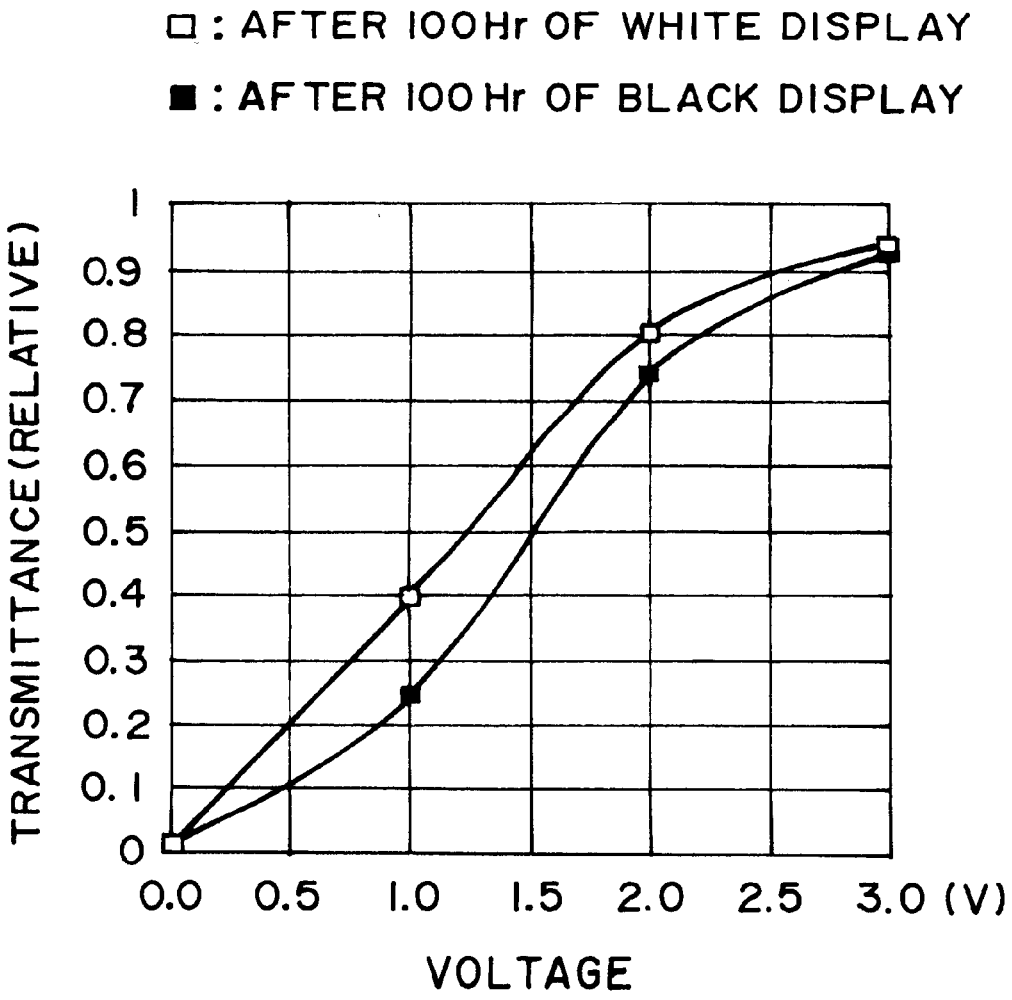
FIG. 17 is a graph showing V-T characteristics when the driving waveforms shown at (a) and (b) in FIG. 16 are applied.

Further, as described with reference to FIGS. 16 and 17, when the conventional liquid crystal device employing a fixed reset voltage is driven for gradational display after driven for successive whit display (100 Hr) (FIG. 16(*a*)) and for successively black display (100 Hr)(FIG. 16(*b*)), the resultant VT characteristics are different from each other (FIG. 17), thus causing the image memory phenomenon.

Figure 5:
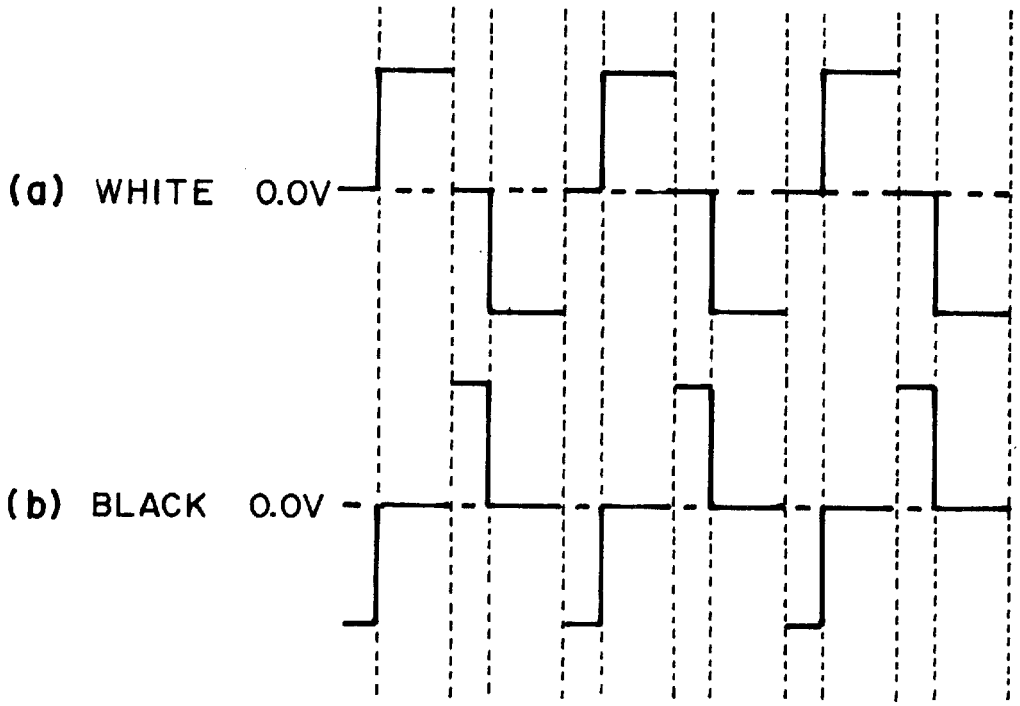
FIG. 5 shows at (a) a driving waveform for continuously (successively) displaying a white state and at (b) a driving waveform for continuously displaying a black state usable in the driving method of the present invention.
Figure 6:
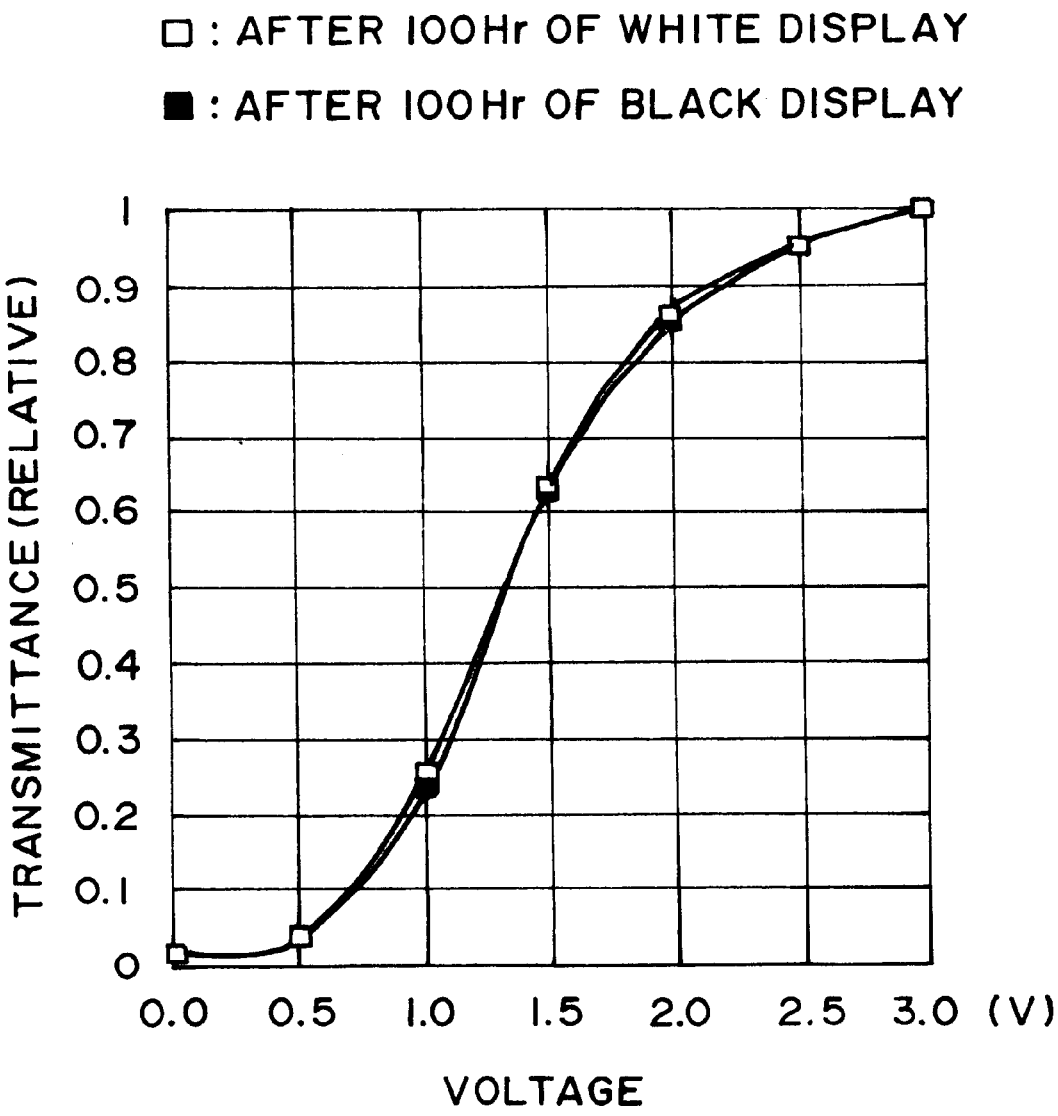
FIG. 6 is a graph showing V-T characteristics when the driving waveforms shown at (a) and (b) in FIG. 5 are applied.

On the other hand, the reset voltage used in the driving method of the present invention is not fixed but changed depending on the data voltage determined based on gradational data while providing a prescribed difference with the data voltage. As a result, the image memory phenomenon is not caused in the driving method of the present invention to retain good image qualities. Specifically, FIG. 5 shows at (a) a driving waveform for successively displaying a white state and at (b) a driving waveform for successively displaying a black image. In either case, magnitudes and polarities of a set of a reset voltage $V_R$ and a data voltage $V_D$ are alternately changed for a prescribed period (at (a) and (b) of FIG. 5). In other words, a certain voltage is not applied for a long period in the driving method of the present invention, thus not changing a VT characteristic (FIG. 6). Accordingly, good display qualities are retained even when the liquid crystal device is driven under extreme display conditions (continuous white (or black) display operation).

Further, as apparent from FIG. 1 (at (e)), by setting the superposition voltage Vα so as to coincide with a voltage providing a maximum temperature (having the same absolute value but a different polarity), the liquid crystal 1 successively supplied with a reset voltage $V_R$ and a data voltage $V_D$ in each field period ($F_1$, $F_2$) is always placed in a non-voltage application state as a transitional state during the successive voltage application operation comprising the rate voltage application and the data voltage application. In this case, when the liquid crystal 1 shows a transmittance of substantially 0% under no voltage application, the liquid crystal 1 is always temporarily placed in a black state before shows a desired gradational display state, thus improving display qualities of gradational images.

In addition, when the display method of the present invention is performed in accordance with the field-sequential driving scheme as described above, image reset operation in each frame period is ensured to improve color reproducibility of full-color images.

Hereinbelow, the present invention will be described based on Examples.

EXAMPLE 1

A liquid crystal panel (liquid crystal device) P1 having a circuit structure as shown in FIG. 2 was driven by a driving method according to the present invention as illustrated in FIG. 1.

A liquid crystal 1 used in this example was a smectic liquid crystal composition providing a VT characteristic as shown in FIG. 3 and prepared by mixing the following compounds in the indicated proportions.

| Structural Formula | wt. parts |
|---|---|
| 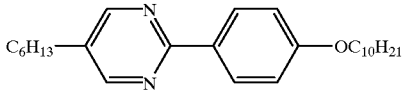 | 11.55 |
| 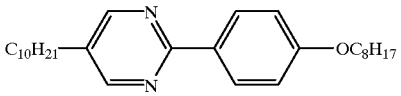 | 11.55 |

-continued

| Structural Formula | wt. parts |
|---|---|
| 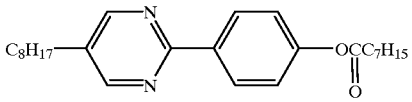 | 7.70 |
| 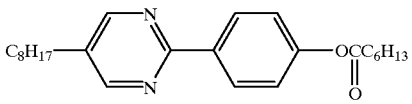 | 7.70 |
| 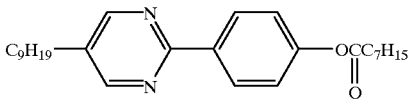 | 7.70 |
| 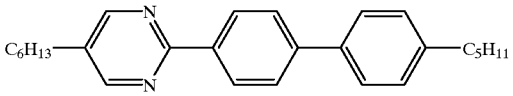 | 9.90 |
| 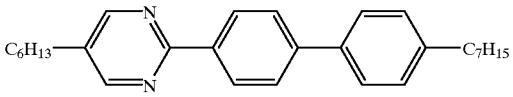 | 9.90 |
| 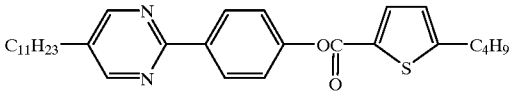 | 30.0 |
| 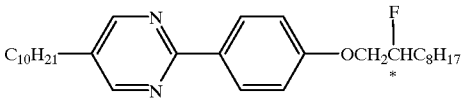 | 4.00 |

The thus-prepared liquid crystal composition LC-1 showed the following phase transition series and physical properties.

Phase Transition Temperature (C)

$$\text{Iso} \xrightarrow{86.3} \text{Ch} \xrightarrow{61.2} \text{SmC*} \xrightarrow{-7.2} \text{Cry}$$

(Iso: isotropic phase, Ch: cholesteric phase, SmC*: chiral smectic phase)

Spontaneous polarization (Ps): 2.9 nC/cm$^2$ (30° C.)

Cone angle Ⓗ: 23.3 degrees (30° C., 100 Hz, ±12.5 V)

Helical pitch (SmC*): at least 20 μm (30° C.)

A blank cell was prepared in the following manner.

A pair of glass substrates each provided with a transparent electrode of ITO film was provided.

On each of the transparent electrodes (of the pair of glass substrates), a polyimide precursor ("SE7992", mfd. by Nissan Kagaku K.K.) for forming a polyimide was applied by spin coating and pre-dried at 80° C. for 5 min., followed by hot-baking at 200° C. for 1 hour to obtain a 500 Å-thick polyimide film.

Each of the thus-obtained polyimide film was subjected to rubbing treatment (as a uniaxial aligning treatment) with a nylon cloth under the following conditions to provide an alignment control film.

Rubbing roller: a 10 cm-dia. roller about which a nylon cloth ("NF-77 ", mfd. by Teijin K.K.) was wound.

| | |
|---|---|
| Pressing depth: | 0.3 mm |
| Substrate feed rate: | 10 cm/sec |
| Rotation speed: | 1000 rpm |
| Substrate feed: | 4 times |

Then, on one of the substrates, silica beads (average particle size =1.5 μm) were dispersed and the pair of substrates were applied to each other so that the rubbing treating axes were in parallel with each other but oppositely directed (anti-parallel relationship), thus preparing a blank cell with a uniform cell gap of ca. 1.4 μm.

The liquid crystal composition prepared above was injected into each of the above-prepared blank cell in its isotropic liquid state and gradually cooled to a temperature providing chiral smectic C phase to prepare an active matrix-type liquid crystal device.

In the above cooling step from Iso to SmC*, the cell (device) was subjected to a voltage application treatment such that a DC (offset) voltage of −2 volts was applied before and after the phase transition (Ch-SmC*) in a prescribed temperature range.

In this example, each frame period $F_0$ was set to 1/60 sec and divided into a first field period F, and a second field period $F_2$ ($F_1$:$F_2$=1:1). Each field period (e.g., $F_1$) was divided into a first sub-field period $F_{11}$ (=1 msec) and a second sub-field period $F_{12}$ (=7.3 msec).

The liquid crystal device (as shown in FIG. 2) was driven by using a set of driving waveforms shown at (a) to (e) in FIG. 1.

Gate (scanning) lines 4 were successively supplied with a gate voltage (in a line-sequential scanning manner) to turn successively respective first switching element 3 "ON" state (as shown at (a) in FIG. 1). At the same time, a data voltage $V_D$ was applied to source (signal) lines 5, whereby in each pixel the data voltage $V_D$ was stored or held in a first storage capacitor 6 via a corresponding switching element 3 to provide a first buffer circuit 7 with an output potential equal to the data voltage $V_D$. The line-sequential scanning operation was performed in a preceding frame (not in a current frame wherein the data voltage $V_D$ was actually applied to the liquid crystal 1).

A second switching element 8 at each pixel was in "OFF" state during the above drive operation and was turned "ON" after completion of the drive operation, i.e., was turned "ON" by applying a common signal to a common signal line after the data voltage $V_D$ was completely outputted to the first buffer circuits 7 of all the pixels (at (b) in FIG. 1). As a result, at all the pixels, the data voltage $V_D$ was stored in a second storage capacitor 13 and at the same time, was applied to a pixel electrode 2*a* via a second buffer circuit 9. At that time, the second switching element 8 was immediately turned "OFF" but the data voltage $V_D$ was still held in the second storage capacitor 13. As a result, the pixel electrode 2*a* was continuously supplied with the data voltage $V_D$ (at (c) in FIG. 1). The output of the second buffer circuit 9 was low-output impedance. Accordingly, even when a potential of a counter electrode 2*b* was changed, the voltage held by the storage capacitor 13 was continuously outputted.

The liquid crystal 1 at each pixel was supplied with a voltage corresponding to a change in potential between the counter electrode 2*b* and the pixel electrode 2*a*. The potential of the counter electrode 2*b* was changed as shown at (d) in FIG. 1, so that in a first sub-field period (reset period) $F_{11}$, the liquid crystal 1 was supplied with a reset voltage $V_R$ comprising the data voltage $V_D$ superposed with a certain (superposition) voltage Vα of −2.5 V (equal to the counter electrode voltage (potential) of +2.5 V in absolute value but different in polarity therefrom) (i.e., $V_R$ was in the range of 0 V to −2.5 V) (at (e) in FIG. 1). As a result, the preceding display state of the liquid crystal 1 was reset (in $F_{11}$ at (e) in FIG. 1). In a subsequent second sub-field period $F_{12}$, the potential (voltage) of the counter electrode 2*b* was 0 V (at (d) in FIG. 1), so that the liquid crystal 1 at each pixel was supplied with the data voltage $V_D$ (a positive-polarity voltage in the range of 0 to 2.5 V) as it was (at (e) in FIG. 1) to provide a prescribed gradational display state. As a result, a desired gradational image was formed over the entire liquid crystal panel (at (f) in FIG. 1). At that time, a backlight unit (BL) was turned on to illuminate the liquid crystal panel P1 with light (at (g) in FIG. 1), whereby the gradational image formed on the liquid crystal panel P1 became recognizable.

Thereafter, the driving voltage $_D$ and the counter electrode voltage (potential) were changed as shown at (c) and (d) in FIG. 1, whereby the liquid crystal 1 was supplied with a reset voltage ($-V_R$) and a data voltage ($-V_D$) (each having an opposite in polarity to those ($V_R$ and $V_D$) in a first field period $F_1$) in a second field period $F_2$, thus completing one frame period $F_0$. In the frame period $F_0$, the voltage applied to the liquid crystal 1 was modified in an alternating form, thus preventing a deterioration of the liquid crystal 1.

The above drive operation for one frame period was repetitively performed to effect motion picture image display.

According to this example, it was possible to display motion picture images excellent in image qualities while suppressing the image memory phenomenon.

EXAMPLE 2

Figure 7:
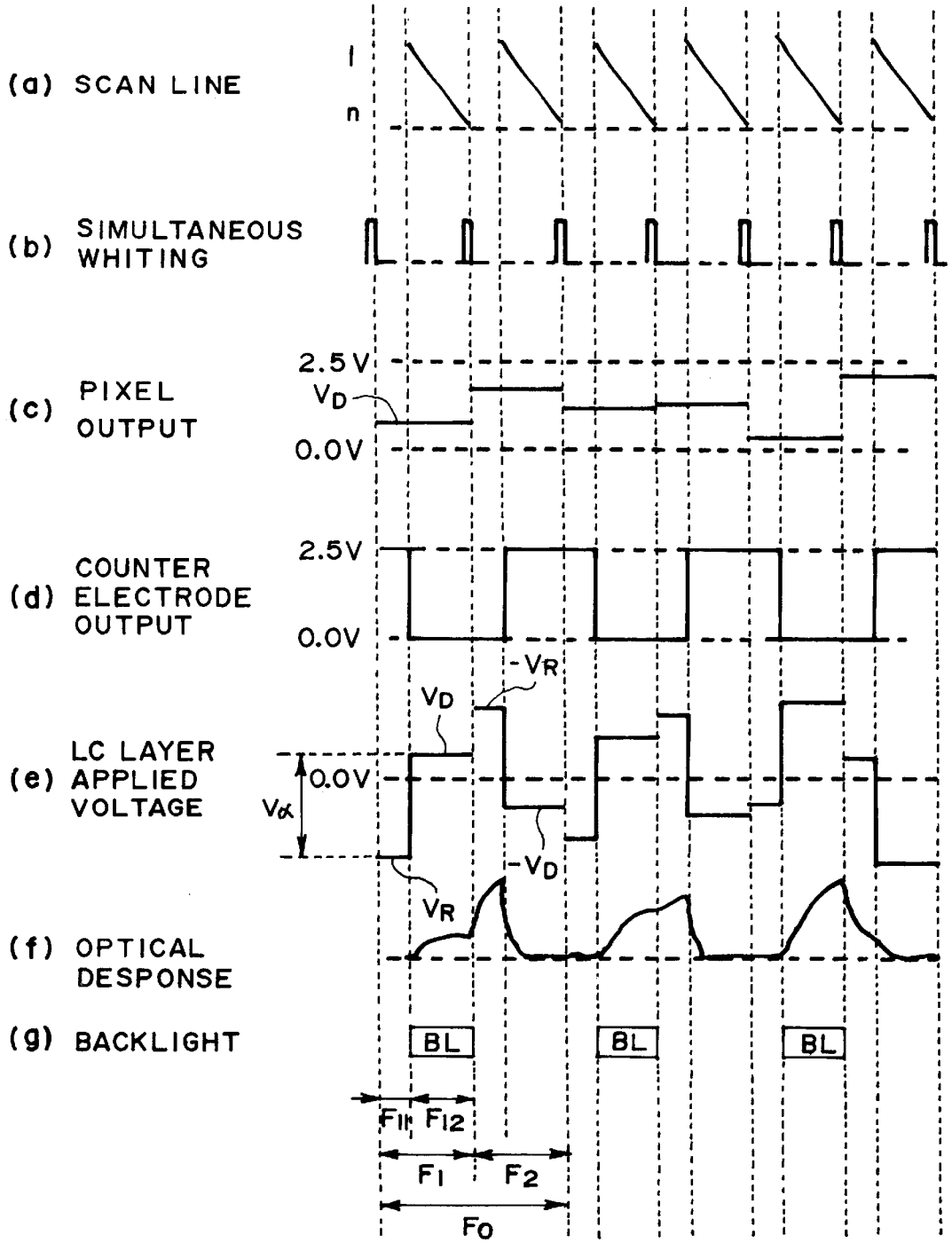
FIGS. 7 and 8 are respectively a time chart for illustrating another embodiment of the driving method for a liquid crystal device of the present invention.

A liquid crystal panel (liquid crystal device) P2 having a circuit structure as shown in FIG. 4 was driven by a driving method of the present invention as illustrated in FIG. 7.

The liquid crystal panel P2 was driven by the driving method in the same manner as in Example 1 except that the second circuit portion including the second buffer circuit 9 and the second storage capacitor 13 was not employed and the scanning manner of the gate lines 4 was correspondingly changed.

Specifically, after the second switching element 8 was turned "OFF", the potential of the pixel electrode 2*a* was fluctuated by modulation of the counter electrode potential while holding a difference between the pixel electrode potential and the counter electrode potential.

For this reason, it is necessary to effect the modulation of the potential of the counter electrode 2*a* in a period wherein the second switching element 8 is placed in a low-impedance state. Further, the potential of the pixel electrode 2*a* is determined based on the voltage stored in the storage capacitance 6.

Accordingly, in this example, the scanning of the gate lines 4 for writing gradational data in the storage capacitor 6 at each pixel was performed in a period (e.g., $F_{12}$ in FIG. 7) wherein the counter electrode potential was not modulated (i.e., a period wherein the data voltage $V_D$ was not superposed with the superposition voltage corresponding to the counter electrode potential).

In this example, the voltage waveform applied to the liquid crystal 1 was similar to that used in Example 1, whereby the effects of Example 1 (good display image qualities free from the influence of preceding state while suppressing the image memory phenomenon) were similarly achieved.

EXAMPLE 3

Color image display was performed by driving a liquid crystal panel P1 (FIG. 2) according to a field-sequential driving scheme with a driving method of the present invention as illustrated in FIG. 8.

In a first set of three field periods $F_1$, $F_2$ and $F_3$, voltage application operations each comprising application of a set of reset voltage and a data voltage ($V_{R1}$ and $V_{D1}$, $V_{R2}$ and $V_{D2}$, and $V_{R3}$ and $V_{D3}$, respectively) and lighting of backlight unit for R (red), G (green) and B (blue) were successively performed, thus displaying successively respective color images. In a second set of three field periods $F_4$, $F_5$ and $F_6$, lighting of backlight unit was interrupted and voltage application operations each comprising application of a set of reset voltage and a data voltage each having an opposite in polarity to those in the first set of three field periods $F_1$, $F_2$ and $F_3$ ($-V_{R1}$ and $-V_{D1}$, $-V_{R2}$ and $-V_{D2}$, and $-V_{R3}$ and $-V_{D3}$, respectively), thus suppressing the liquid crystal deterioration due to DC component of the applied voltage.

Figure 9:
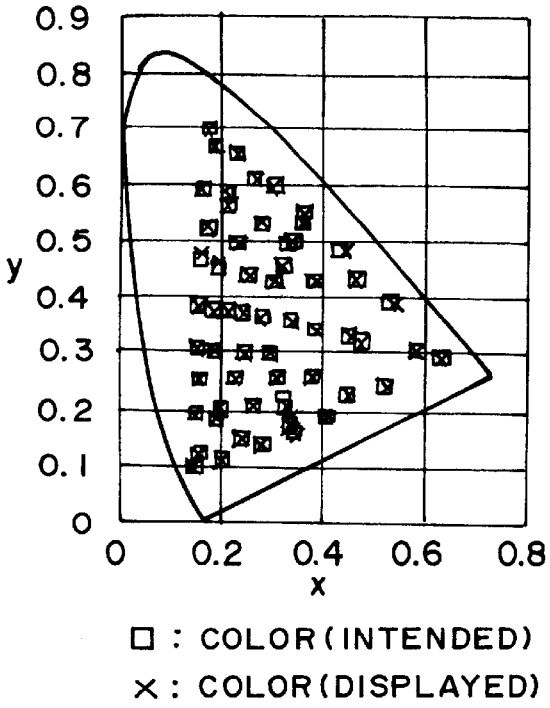
FIGS. 9 and 10 are chromaticity diagrams for a liquid crystal device used in the present invention and a conventional liquid crystal device, respectively.

FIG. 9 is a chromaticity diagram obtained by using the above driving method, wherein data indicated by (□) are colors to be intended to be displayed and data indicated by (x) are colors actually displayed by the above driving method.

As apparent from FIG. 9, it was found that it was possible to substantially faithfully reproducing the desired color images.

Figure 10:
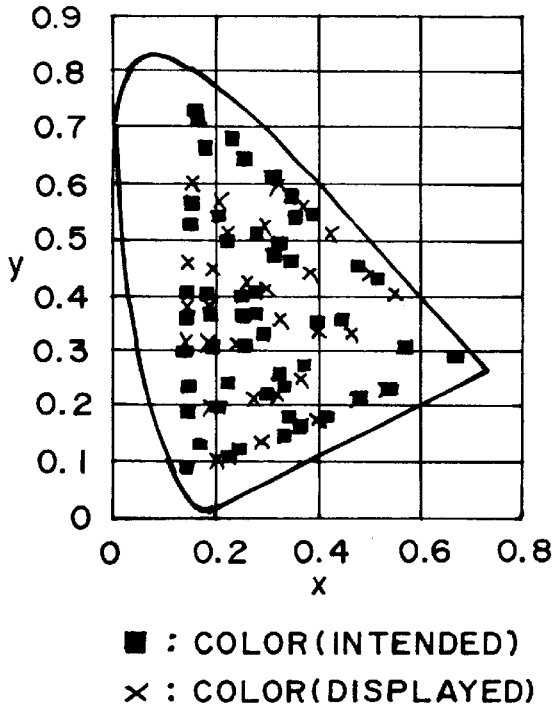
Figure 11:
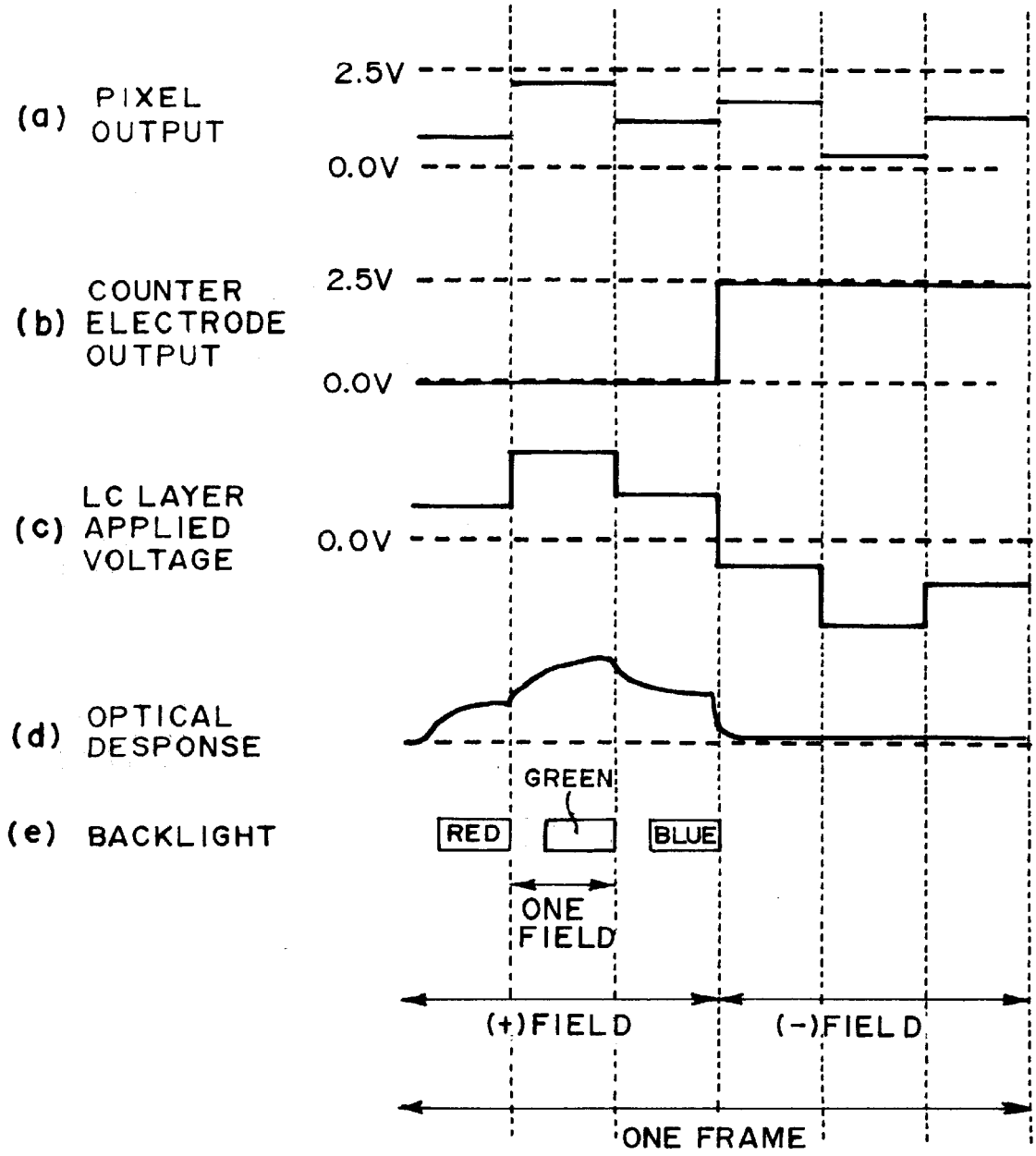
FIG. 11 is a time chart for illustrating an embodiment of a conventional driving method according to a field-sequential driving scheme.

For comparison, when color image display was performed by using a conventional driving method as illustrated in FIG. 11, a chromaticity diagram shown in FIG. 10 was obtained.

As apparent from FIG. 10, actually displayed colors were considerably different from those intended to be displayed.

Accordingly, the driving method of the present invention is effective in improving color reproducibility.

EXAMPLE 4

Figure 13:
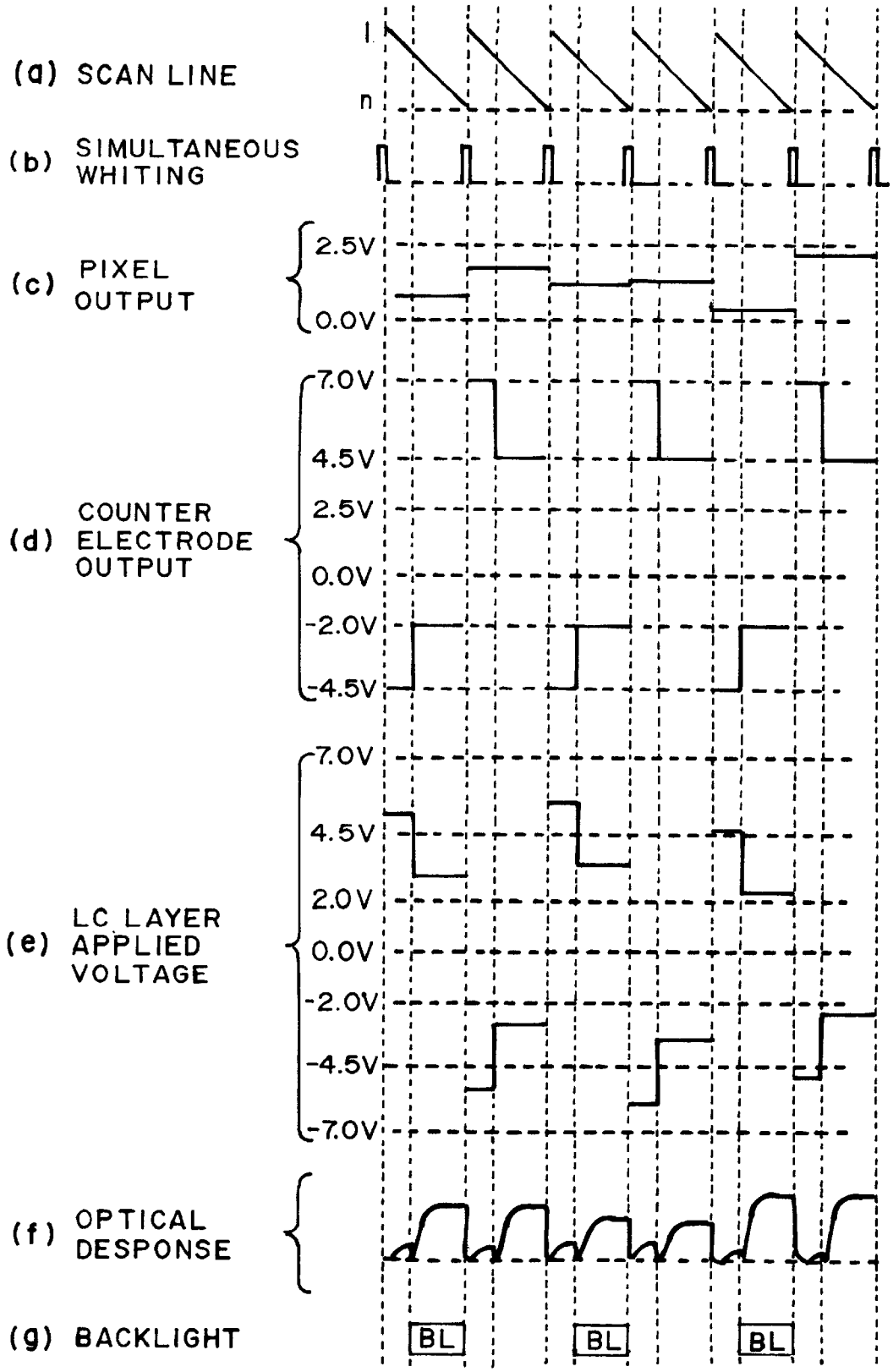
FIGS. 13 and 14 are time charts for illustrating another embodiment of the driving method of the present invention and a conventional driving method, respectively.

A liquid crystal panel P1 as shown in FIG. 2 was driven by a driving method of the present invention as illustrated in FIG. 13.

Figure 12:
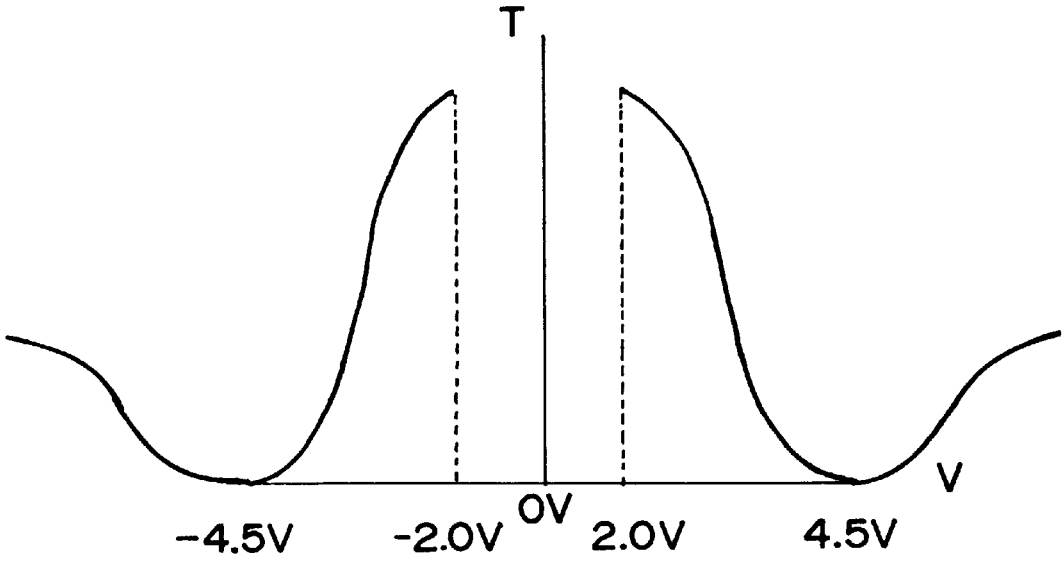
FIG. 12 is a graph showing another embodiment of a V-T characteristic of a liquid crystal used in the driving method of the present invention.

The liquid crystal panel P1 was an optically compensated bend (OCB)-mode liquid crystal device using a nematic liquid crystal providing a V-T characteristic as shown in FIG. 12. The liquid crystal panel P1 further comprised a pair of polarizers and a phase compensation plate.

Specifically, the liquid crystal panel P was prepared in the following manners

A pair of glass substrates each provided with a transparent electrode of ITO film was provided.

On each of the transparent electrodes, a solution for an alignment film comprising 3.0 wt. %-first alignment component for homeotropic alignment ("SE-1211", mfd. by Nissan Kagaku K.K.) in nBC (or NMP) and a second alignment component for almost homogeneous alignment ("AL-0656", mfd. by Nippon Gosei Gomu K.K.) was applied an dried, followed by hot-baking at 200° C. for 1 hour to form a 30 nm-thick alignment film.

Each of the thus-obtained alignment film was subjected to rubbing treatment (as a uniaxial aligning treatment) with a cotton cloth under the following conditions.

Rubbing roller: a 8 cm-dia. roller about which a cotton cloth was wound.

Pressing depth: 0.3 mm

Substrate feed rate: 5 cm/sec

Rotation speed: 1000 rpm

Then, on one of the substrates, silica beads (average particle size =6 $\mu$m) were dispersed and the pair of substrates were applied to each other so that the rubbing treating axes were in parallel with each other and directed in the same direction, thus preparing a blank cell with a uniform cell gap of ca. 1.4 $\mu$m.

Into the blank cell, a fluorine-containing nematic liquid crystal free from a chiral component ("KN-5027", mfd. by Chisso K.K.) was injected to prepare a liquid crystal device.

The thus-prepared liquid crystal device was sandwiched between a pair of cross-nicol polarizers so that the rubbing axis of the liquid crystal device was arranged to form an angle of 45 degrees with the polarizing axes of the polarizers. Further, a phase compensation film (retardation =90 nm) was disposed between the liquid crystal device and one of the pair of polarizers so that an optical axis of the phase compensation film was arranged to form an angle of 90 degrees with the rubbing axis of the liquid crystal device, thus preparing an OBC-mode liquid crystal device.

The OCB mode is a display mode such that liquid crystal molecules are supplied with a voltage to change their alignment state to bend alignment state and vertical alignment state, thus providing an opaque state (back state) and a transparent state (white state).

Referring to FIG. 12, in transparent states under application of voltage of 2.0 V and −2.0 V, the liquid crystal molecules are placed in the bend alignment state. On the other hand, in opaque states under application of voltages of 4.5 and −4.5 V, the liquid crystal molecules are placed in substantially vertical alignment state.

In this example, a gradational display (change in transmittance between the transparent and opaque states) is performed between the voltage of 2.0 V (or −2.5 V) and the voltage of 4.5 V (or −4.5 V). Between the voltage of −2.0 V and the voltage of below 2.0 V, the liquid crystal molecules are placed in splay alignment state, so that a resultant transmittance is not necessarily identified and thus is not shown in FIG. 12.

In the driving method shown in FIG. 13, a data voltage and a counter electrode (output) voltage (potential) were set so as not to apply a voltage of below 2.0 V (as absolute value) in a writing period (for applying the data voltage) subsequent to a reset period (for applying a reset voltage).

Specifically, in the first reset period, a data voltage of 1.0 V and a counter electrode voltage of −4.5 V were combined to form a voltage of 5.5 V applied to the liquid crystal 1. In other words, the applied voltage (5.5 V) to the liquid crystal 1 comprised the data voltage (1.0 V) superposed with a superposition voltage of 4.0 V (being equal in absolute value to but different in polarity from the counter electrode voltage (−4.5 V)). Accordingly, in this example, the superposition voltage was identical in polarity to the data voltage, different from those used in Example 1.

The pixel electrode voltage was set in the range of 0.0 V to 2.5 V since the voltage difference between a maximum-transmittance voltage of 2.0 V (or −2.0 V) and a minimum-transmittance voltage of 4.5 V (or −4.5 V) was 2.5 V.

In the writing period (for applying the data voltage) subsequent to the reset period, the data voltage of 1.0 V and the counter electrode voltage of −2.0 V were combined to form a voltage of 3.0 V applied to the liquid crystal 1. At that time, the backlight unit (BL) was turned on, thus displaying a prescribed gradational image. During the transition of display states of the liquid crystal molecules between that (under application of 5.5 V) in the reset period and that (under application of 3.0 V) in the writing period, the liquid crystal molecules was caused to be temporarily placed in the darkest state (under application of 4.5 V).

In a subsequent set of a reset period and a writing period, a rate voltage of −5.5 V and a liquid crystal-application voltage of −3.0 V (i.e., both were different in polarity from those in the preceding set of reset and writing periods).

In this example, the lighting of the backlight unit (BL) was effected in the writing period wherein the position liquid crystal-application voltage was applied to the liquid crystal 1.

It is also possible to effect the lighting of the backlight while applying a negative-polarity voltage to the liquid crystal 1 since the liquid crystal 1 used provided a continuous transmittance change between the opaque and transparent states on the negative voltage side (FIG. 12).

In this example, similarly as in Examples 1 and 2, it was possible to achieve good display image qualities free from the influence of preceding state while preventing the image memory phenomenon.

As described hereinabove, according to the present invention, each reset voltage is set to provide a prescribed difference in voltage between the reset voltage and a subsequent data voltage by superposing a prescribed voltage on a data voltage. As a result, it is possible to simplify a circuit structure of a liquid crystal device driven by the driving method of the present invention when compared with a conventional driving method using a particular reset circuit for exclusively applying a fixed reset voltage. The voltage difference between the reset voltage and the data voltage is effective in obviating the influence of a previous display state on a subsequent display state, thus allowing appropriate gradational image display with improved image qualities.

In the conventional driving method, due to the use of the fixed reset voltage, a certain gradational image display causes a change in VT characteristic, whereby a resultant gradational image displayed over the entire display area is different from one intended to be displayed, thus resulting in an occurrence of image memory phenomenon.

In the present invention, the reset voltage is not fixed, thus being free from the image memory phenomenon.

Further, when the voltage difference between the data voltage and the data voltage corresponds to a voltage value which is equal in absolute value to but different in polarity from a voltage providing a maximum transmittance, the liquid crystal supplied successively with the reset voltage and data voltage always goes through a state where a voltage is not applied (i.e., applied voltage 0 V). In this case, if the liquid crystal used provides a transmittance of 0% under no voltage application, the liquid crystal always goes through a black display state before provides a desired gradational display state, thus improving image qualities.

Further, in the case of effecting a full-color image formation by driving a liquid crystal device through the driving method of the present invention in a field-sequential manner, in each frame period, image reset operation is surely performed based on the voltage difference between the reset voltage and the data voltage, thus resulting in an improved color reproducibility of full-color images.

What is claimed is:

1. A driving method for a liquid crystal device comprising a pair of electrodes and a liquid crystal disposed between the electrodes, said driving method comprising:

a sequence of voltage application operations, each sequence comprising: (1) application of a reset voltage to the liquid crystal, for placing the liquid crystal in a reset state in a reset period, and (2) application of a data voltage to the liquid crystal for placing the liquid crystal in a desired gradational display state in a writing period subsequent to the reset period, wherein each reset voltage is set to provide a prescribed difference in voltage between said each reset voltage and a subsequent data voltage, and wherein said prescribed difference in voltage is substantially equal in absolute value to a voltage providing a maximum transmittance of said liquid crystal device.

2. A method according to claim 1, wherein the liquid crystal comprises a smectic liquid crystal.

3. A method according to claim 2, wherein the liquid crystal provides a voltage-transmittance characteristic such that the liquid crystal: (1) provides a transmittance of substantially 0% when supplied with no voltage, (2) exhibits a larger transmittance change, continuously and moderately, when supplied with a voltage of a first polarity, and (3) exhibits a smaller transmittance change, continuously and moderately, when supplied with a voltage of a second polarity opposite to the first polarity.

4. A method according to claim 1, wherein the prescribed difference in voltage is controlled depending on an ambient temperature of the liquid crystal device.

5. A method according to claim 1, wherein the liquid crystal device is illuminated with light after being supplied with the data voltage.

6. A method according to claim 1, wherein the writing period of the data voltage applied to the liquid crystal is determined depending on an ambient temperature of the liquid crystal device.

7. A method according to claim 1, wherein after the liquid crystal is supplied with the reset voltage and the data voltage, the liquid crystal is sequentially supplied with another reset voltage and another data voltage which are substantially equal in absolute value to but different in polarity from the reset voltage and the data voltage, respectively.

8. A method according to claim 1, wherein the liquid crystal device is illuminated with light which is changed in color depending on a plurality of images to be displayed in synchronism with sequential application of a reset voltage and a data voltage thereby to display the images as color images.

9. A method according to claim 1, wherein the prescribed difference in voltage is different in polarity from said voltage providing the maximum transmittance.

* * * * *

UNITED STATES PATENT AND TRADEMARK OFFICE

CERTIFICATE OF CORRECTION

PATENT NO. : 6,703,993 B2
DATED : March 9, 2004
INVENTOR(S) : Seishi Miura et al.

It is certified that error appears in the above-identified patent and that said Letters Patent is hereby corrected as shown below:

Sheet 1,
Figure 1, (f), “DEPONSE” should read -- RESPONSE --.

Sheet 5,
Figure 7, (f), “DEPONSE” should read -- RESPONSE --.

Sheet 6,
Figure 8, (f), “DEPONSE” should read -- RESPONSE --.

Sheet 8,
Figure 11, (d), “DEPONSE” should read -- RESPONSE --.

Sheet 10,
Figure 13, (f), “DEPONSE” should read -- RESPONSE --.

Figure 14:
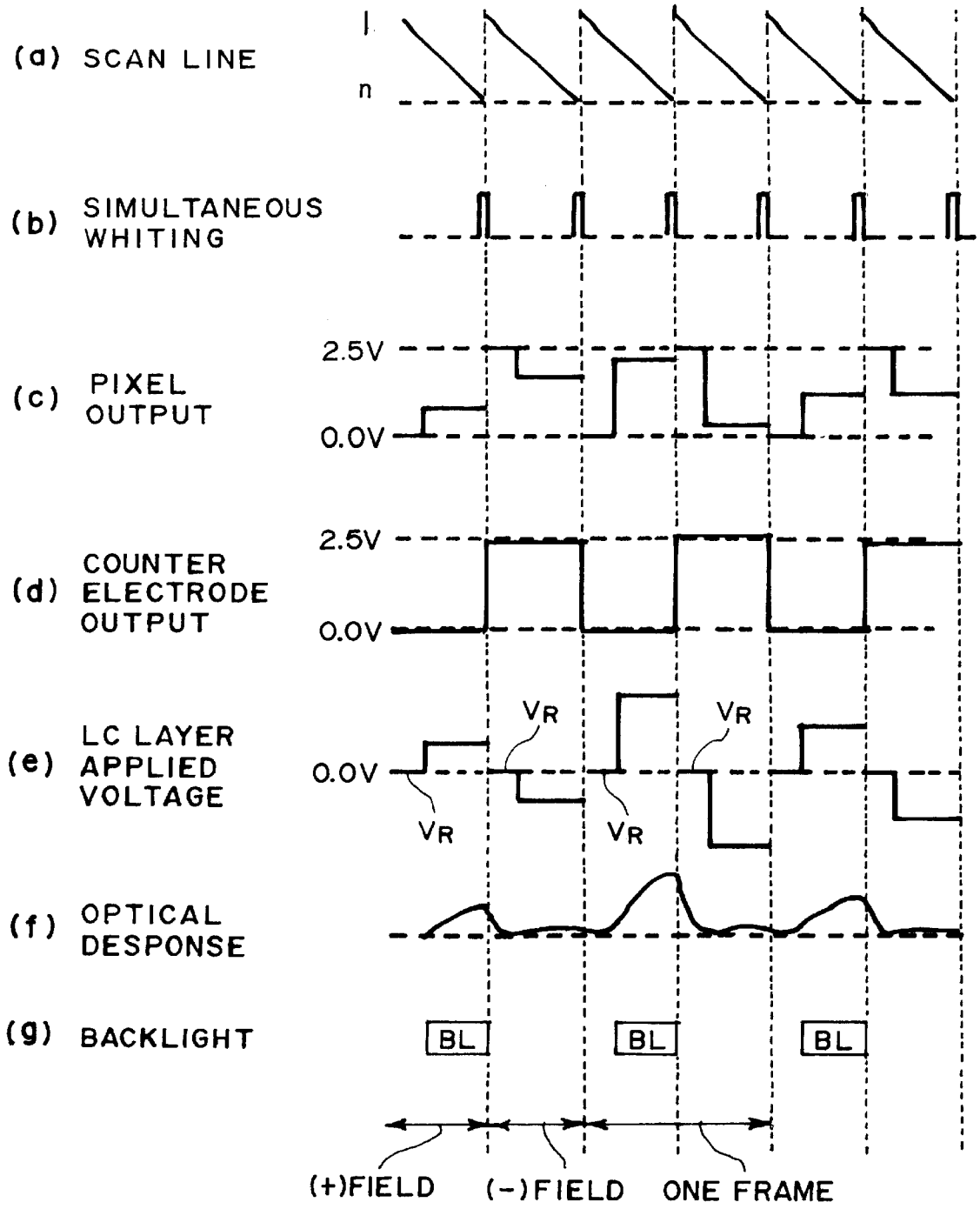

Sheet 11,
Figure 14, (f), “DEPONSE” should read -- RESPONSE --.

Column 1,
Line 53, “to be” should be deleted;
Line 56, “(chandani,” should read -- (Chandani, --; and
Line 58, “L729-).” should read -- L729-L732). --.

Column 2,
Line 2, “pp. 3586-)” should read -- pp. 3586-3590). --;
Line 9, “image” should read -- images --; and
Line 53, “in” should read -- is --.

Column 3,
Line 4, “ia” should read -- a --.

Column 4,
Line 53, “element” should read -- elements --

Column 7,
Line 26, “operation” should read -- operations --; and
Line 31, “shows” should read -- showing --.

Column 8,
Line 62, “film” should read -- films --.

UNITED STATES PATENT AND TRADEMARK OFFICE

CERTIFICATE OF CORRECTION

PATENT NO. : 6,703,993 B2
DATED : March 9, 2004
INVENTOR(S) : Seishi Miura et al.

It is certified that error appears in the above-identified patent and that said Letters Patent is hereby corrected as shown below:

Column 9,
Line 15, “cell” should read -- cells --; and
Line 25, “F,” should read -- $F_1$ --.

Column 11,
Line 27, “reproducing” should read -- reproduce --;
Line 48, “manners” should read -- manner. --;
Line 54, “nBC” should read -- NBC --; and
Line 57, “an” should read -- and --.

Column 12,
Line 66, “was” should read -- were --.

Column 13,
Line 49, “provides” should read -- providing --.

Signed and Sealed this

Twenty-seventh Day of July, 2004

JON W. DUDAS
*Acting Director of the United States Patent and Trademark Office*